United States Patent [19]

Sakurai

[11] 4,414,929

[45] Nov. 15, 1983

[54] LUBRICATION SYSTEM FOR TWO-CYCLE INTERNAL COMBUSTION ENGINES

[75] Inventor: Yoshihiro Sakurai, Iwata, Japan

[73] Assignees: Yamaha Hatsudoki Kabushiki Kaisha, Iwata; Sanshin Kogyo Kabushiki Kaisha, Hamamatsu, both of Japan

[21] Appl. No.: 390,376

[22] Filed: Jun. 21, 1982

[30] Foreign Application Priority Data

Jul. 1, 1981 [JP] Japan ..... 56-103720

[51] Int. Cl.[3] ..... F02B 33/04

[52] U.S. Cl. ..... 123/73 R; 123/73 A; 123/73 AD; 123/196 R

[58] Field of Search ..... 123/73 AD, 73 A, 73 R, 123/196 R

[56] References Cited

U.S. PATENT DOCUMENTS

| | | | |
|---|---|---|---|
| 1,606,424 | 11/1926 | Irgens et al. | 123/73 A |
| 2,759,716 | 8/1956 | Jones | 123/73 R |
| 3,472,211 | 10/1969 | Meininger | 123/73 R |
| 3,690,304 | 9/1972 | Schneider et al. | 123/73 A |
| 4,121,551 | 10/1978 | Turner | 123/73 A |
| 4,204,489 | 5/1980 | Onishi | 123/73 R |
| 4,261,305 | 4/1981 | Ikoma | 123/73 AD |
| 4,372,258 | 2/1983 | Iwai | 123/73 AD |

FOREIGN PATENT DOCUMENTS

| | | | |
|---|---|---|---|
| 2912476 | 10/1980 | Fed. Rep. of Germany | 123/73 AD |
| 56-12008 | 2/1981 | Japan | 123/73 AD |

*Primary Examiner*—Wendell E. Burns

*Attorney, Agent, or Firm*—Ernest A. Beutler

[57] ABSTRACT

Two embodiments of lubricating systems for two-cycle internal combustion engines wherein a fuel/lubricant mixture is provided from a carburetor directly to certain components of the engine to be lubricated such as the rod bearings. This separate lubricant passage receives a fuel/lubricant/air mixture and is independent of the main intake passage of the engine. In one embodiment, a separate fuel/lubricant inlet extends into the carburetor downstream of the main induction nozzle. In the other embodiment, this separate lubricant passage has its own induction passage and own fuel/lubricant discharge nozzle.

8 Claims, 4 Drawing Figures

Fig-3
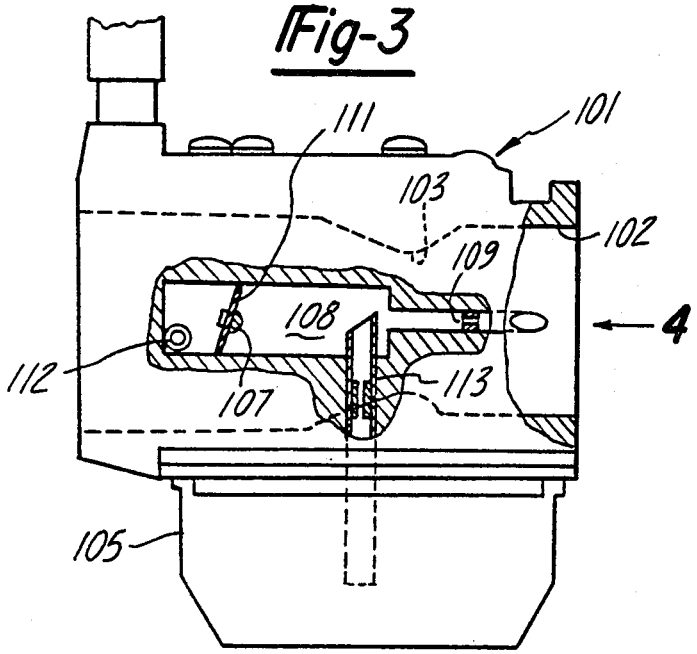
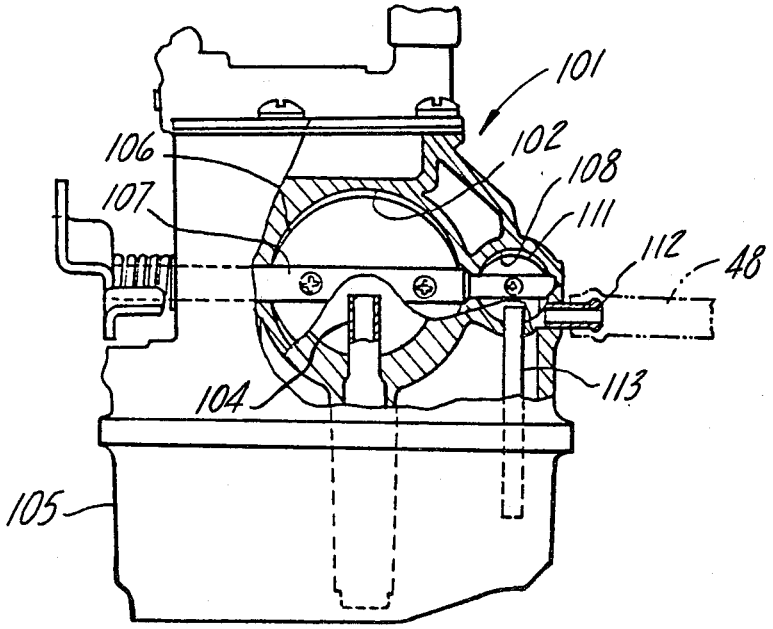
Fig-4

LUBRICATION SYSTEM FOR TWO-CYCLE INTERNAL COMBUSTION ENGINES

BACKGROUND OF THE INVENTION

This invention relates to a lubrication system for two-cycle internal combustion engines and more particularly to an improved and simplified lubricating system for such engines.

As is well known with two-cycle type engines, the fuel/air charge is introduced into the crankcase for compression and transfer to the cylinders. Frequently, lubricant is mixed with the fuel so that the components of the engine can be lubricated without the need for a separate lubricant pump and delivery system. Such an arrangement offers simplicity for the engine and cost reduction. However, there are some disadvantages in mixing lubricant with the fuel for lubricating the engine. First of all, the consumption of lubricant may be higher than with systems having separate lubricating arrangements. Also, under some running conditions, there is a danger of lack of sufficient lubrication for certain components of the engine. For example, under low speed running, there may be insufficient lubrication for the crankshaft journals and the connecting rod crankshaft journals. The lubrication problem is particularly prevelant when the engine is operated with fuels having low lubricity such as kerosene or the like. Although positive lubricating systems will overcome these difficulties, the use of a separate, positive lubricating system adds to the complexity and further requires the assurance that sufficient lubrication will be provided through all running conditions. This is normally accomplished by employing an expensive oil pump that has an output related to engine speed and load.

It is, therefore, a principal object of this invention to provide an improved lubricating system for two-cycle internal combustion engines.

It is a further object of the invention to provide a two-cycle lubricating system in which lubricant is mixed with the fuel and delivery to the critical components is insured under all running conditions.

SUMMARY OF THE INVENTION

This invention is adapted to be embodied in a lubricating system for a two-cycle engine of the type in which fuel and lubricant are mixed and delivered to the engine from a charge forming device. An induction passage is incorporated through which a fuel/lubricant mixture is delivered through an induction passage outlet to a chamber of the engine. In accordance with the invention, lubricant passage means communicate with at least a portion of the engine to be lubricated and means deliver a fuel/lubricant mixture to said lubricating passage means independently of the induction passage outlet.

BRIEF DESCRIPTION OF THE DRAWINGS

FIG. 3 is an enlarged side elevational view of a carburetor constructed in accordance with another embodiment of the invention, with portions broken away.

FIG. 4 is an end elevational view of the carburetor of FIG. 3, with further portions broken away.

DETAILED DESCRIPTION OF THE PREFERRED EMBODIMENTS

Figure 1:
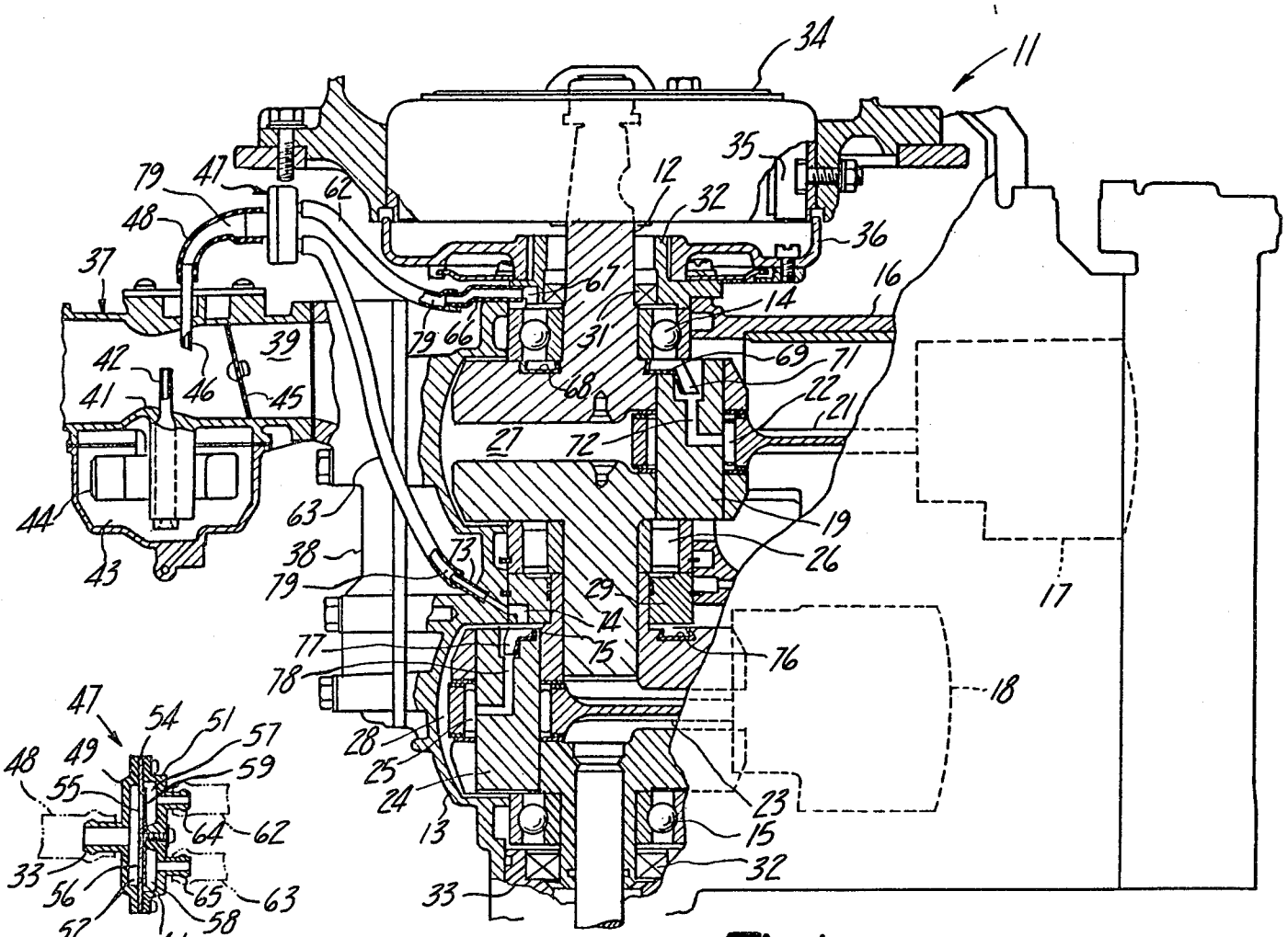
FIG. 1 is a side elevational view, with portions broken away and other portions shown in section, of an internal combustion engine embodying this invention.

In the drawings, the reference numeral 11 indicates an internal combustion engine constructed in accordance with the invention. In the illustrated embodiment, the engine 11 is an outboard motor that has a built up crankshaft 12 supported for rotation about a vertically extending axis. The crankshaft 12 is journalled between a crankcase 13 of the engine 11 and a cylinder block 16 by means of a pair of spaced main, roller bearing assemblies 14 and 15. In the illustrated embodiment, the engine 11 is of the two-cylinder type and the cylinder block 16 has cylinder bores in which pistons 17 and 18 are supported for reciprocation. The piston 17 is connected to a throw 19 of the crankshaft 12 by means of a connecting rod 21. The crankshaft end of the connecting rod 21 is connected to the rod bearing of the crankshaft by means of a needle bearing assembly 22. In a like manner, the piston 18 is connected to a connecting rod 23 which is, in turn, connected to a throw 24 of the crankshaft 12 by means of a needle bearing assembly 25.

An intermediate bearing 26 journals the portion of the crankshaft 12 between the throws 19 and 24. The crankcase 13 defines a pair of chambers 27 and 28 which are separated by the bearing 26 and by means of a labyrinth type seal 29 so that the crankcase chambers 27 and 28 are sealed from each other. The upper or outer end of the chamber 27 is sealed by means of a seal 31 that is interposed between the nose of the crankshaft 12 and a retainer 32 for the outer race of the bearing 14. In a like manner, the outer or lower end of the chamber 28 is sealed by means of a seal 32 that is interposed between the crankshaft 12 and a retaining member 33.

A rotor 34 is affixed to the upper end of the crankshaft 12 and carries a permanent magnet 35 that cooperates with an ignition detecting coil (not shown) so as to provide a spark for the engine 11 in a known manner. The ignition detecting coil is supported by a disc 36 that is fixed to the crankcase 13 and which may be rotatable so as to advance and retard the ignition timing, as is well known.

A fuel/air mixture, which also contains lubricant, is supplied to the chambers 27 and 28 by means of a carburetor assembly, indicated generally by the reference numeral 37. The carburetor assembly 37 is affixed to the crankcase 13 by means of a combined manifold and valve body 38. As is well known, the valve body 38 contains reed valves (not shown) which selectively communicate the discharge end 39 of the carburetor 37 with the chambers 27 and 28 at such times as the pistons 17 and 18 are travelling upwardly in their respective cylinder bores.

The carburetor 37 includes a venturi section 41 that is positioned upstream of its discharge end 39. A main nozzle 42 extends into the throat of the venturi section 41 for delivering a mixture of fuel such as kerosene and lubricant to the intake passage from a fuel bowl 43. The fuel and mixed lubricant is maintained in the fuel bowl 43 at a desired level by means of a float 44 and associated needle valve assembly (not shown). A throttle valve 45 is positioned downstream of the venturi section 41 for controlling the flow through the carburetor discharge 39.

A lubricant delivery tube 46 extends into the carburetor induction passage downstream of the throat of the venturi section 42 and nozzle 42. The delivery tube 46 has its inlet end cut off at an angle so that the fuel/lubricant/air mixture flowing through the venturi section 41 will enter this end of the tube 46 with a ram-type effect. The fuel/lubricant/air mixture is delivered from the tube 46 to a check valve assembly, indicated generally by the reference numeral 47, by means of a flexible conduit 48.

Figure 2:
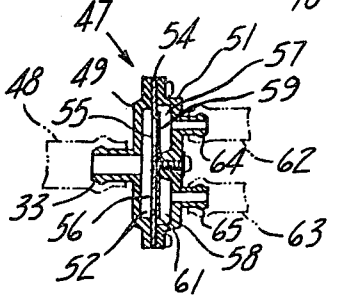
FIG. 2 is an enlarged cross-sectional of the check valve employed in the lubricating system.

As seen in FIG. 2, the check valve assembly 47 is comprised of an outer housing made up of a pair of mating pieces 49 and 51. The piece 49 defines an inlet chamber 52 that is in communication with the conduit 48 by means of an inlet nipple 53. A valve plate 54 is interposed between the housing pieces 49 and 51 and has a pair of openings 55 and 56 that communicate with respective discharge passages 57 and 58. A reed-type valve element having cantilevered end portions 59 and 61 cooperates with the plate 54 to control flow through the openings 55 and 56 to selectively communicate the inlet cavity 52 with the respective discharge cavities 57, 58.

A pair of flexible delivery tubes 62 and 63 extend from discharge nipples 64 and 65 of the respective chambers 57, 58. The tubes 62 and 63 deliver an air/fuel/lubricant mixture to specific portions of the engine to be lubricated in a manner now to be described.

The tube 62 terminates at a fitting 66 that is disposed in proximity to a passage 67 formed in the crankcase 13 and terminating at the bearing 14. Thus, fuel/lubricant/air mixture will be delivered through the passage 67 to lubricate the bearing 14. From the bearing 14, this mixture is delivered to an annular groove 68 of trapezoidal cross-section formed in the cheek of the crankshaft throw 19. A lubricant delivery tray, which may be formed from sheet metal and which is indicated generally by the reference numeral 69, is contained within the recess 67 and has a discharge spout 71 that communicates with a passageway 72 formed in the throw 19 and which terminates at the needle bearing 22. Liquid fuel and lubricant will be delivered from the bearing 14 to the tray 68 by gravity. The fuel and lubricant will then be delivered to the needle bearing 22 from the passageway 67 under centrifugal force generated by rotation of crankshaft 12.

The conduit 63 leaving from the cavity 58 terminates at a nipple 72 that is pressed into the crankcase 13 in proximity to the seal 29. The nipple 73 communicates with a passageway 74 formed in the seal 29. The passageway 74 terminates adjacent the crankshaft cheek which forms the throw 24. An annular recess 75 of trapezoidal cross-section is formed in this cheek and receives a sheet metal oil tray 76. The tray 76 has a discharge spout 77 that delivers fuel and lubricant to an oil passage 78 for delivery of oil to the needle bearings 25 in the same manner as the bearing 22 is lubricated.

The pipe 46, conduit 48, check valve 47, flexible conduits 62 and 63, nipples 66 and 73, and passages 67 and 74 all form oil delivery passages, indicated generally by the reference numerals 79 that are effective to deliver fuel and lubricant to the highly stressed portions of the engine 11. Specifically, these passages deliver oil to the bearing 14 and primarily to the crankshaft needle bearings 22 and 25. The operation by which this is achieved will now be described.

During running of the engine 11, the air flow through the venturi section 41 of the carburetor 37 will cause a fuel/lubricant mixture from the fuel bowl 43 to be mixed with the air flow by the nozzle 42. As the pistons 17, 18, associated with the chambers 27, 28 each undergo upward movement, a negative pressure will be exerted in the respective chamber 27, 28. Because of this negative pressure, the reed valve portions 59 and 61 will selectively open to permit the fuel/lubricant/air mixture trapped by the pipe 46 to be delivered to the engine through the respective oil delivery passages 79 as aforedescribed. Of course, fuel/lubricant/air mixture will also flow from the carburetor induction passage 39 through the manifold 38 to the chambers 27 and 28 to lubricate the remaining components of the engine. However, the provision of separate lubricant supply passages for the bearing 14 and needle bearings 22 and 25 insure that these components are lubricated under all running conditions. The centrifugal force exerted by the rotation of the crankshaft 12 will insure delivery of sufficient lubricant to the bearings 22 and 25. After the bearings 22 and 25 have been lubricated, the remaining fuel/lubricant/air mixture will be transferred from the chambers 27 and 28 to the area above the pistons 17 and 18 in a known manner for eventual combustion.

In the embodiment described, the lubricant delivery inlet pipe 46 is positioned immediately adjacent the downstream end of the main nozzle 42 so as to insure a sufficient flow of fuel and lubricant to the engine needle bearings 22 and 25. FIGS. 3 and 4 show another embodiment of the invention wherein a separate induction passage is provided that serves the lubricant passage 79 only. In this embodiment, a carburetor constructed in accordance with the invention is identified generally by the reference numeral 101. The carburetor 101 is intended for use with an engine of the type shown in the embodiments of FIGS. 1 and 2 and cooperates with a check valve in a similar manner to the previously described embodiment.

The carburetor 101 has a main induction passage 102 that cooperates with the manifold 38 for delivering a fuel/lubricant/air mixture to the manifold. For this purpose, the main intake passage 102 has a venturi section 103 into which a main discharge nozzle 104 extends. The main discharge nozzle 104 draws fuel and lubricant from a fuel bowl 105 in a known manner. A main throttle valve 106 is positioned in the main intake passage 102 downstream of the venturi section 103. The main throttle valve 106 is affixed to a main throttle valve shaft 107 that is rotatably supported in the body of the carburetor.

Parallel to the main induction passage 102, the carburetor body is formed with a supplemental induction passage 108 that receives an air charge through an air metering jet 109 which, in turn, communicates with the main intake passage 102 upstream of the main throttle valve 106 and upstream of the venturi section 103. A supplemental throttle valve 111 is affixed to the throttle valve shaft 107 which also passes through the induction passage 108. The downstream end of the supplemental induction passage 108 is blind and communicates with a discharge nipple 112 that supplies the conduit 48 of an engine as in the previously described embodiment in which a check valve and suitable delivery passages are provided. A supplemental fuel/lubricant discharge nozzle 113 is positioned in the supplemental induction passage 108 and communicates with the fuel bowl 105 so that fuel and lubricant may be drawn into the passage 108 for delivery to the check valve and needle bearings of the engine as in the previously described embodiment.

This embodiment operates as the previous embodiment. During all running conditions, a fuel/lubricant mixture will be discharged from both the main intake passage 102 to lubricate the main components of the engine and a fuel/lubricant/air mixture will be discharged from the secondary intake passage 108 to lubricate the main bearing 14 and the needle bearings 22 and 25 of the previously described embodiment.

It should be readily apparent that embodiments of the invention have been disclosed that insure good lubrication of the highly stressed components of the engine under all running conditions without the necessity of providing a separate oil pump for this purpose. As a result, the cost of the engine can be reduced and the consumption rate of lubricant also can be reduced. On the other hand, good lubrication is provided under all running conditions. Various changes and modifications of the invention may be made without departing from the spirit and scope of the invention, as defined by the appended claims.

I claim:

1. In a lubricating system for a two-cycle engine of the type in which fuel and lubricant are mixed and delivered to the engine from a charge forming device including an induction passage through which a fuel lubricant mixture is delivered through an induction passage outlet to a chamber of the engine, the improvement comprising lubricant passage means communicating with at least a portion of said engine to be lubricated and means for delivering a fuel lubricant mixture to said lubricating passage means independently of said induction passage outlet.

2. In a lubricating system as set forth in claim 1 wherein the portion of the engine to be lubricated is in the chamber.

3. In a lubricating system as set forth in claim 1 wherein the engine includes a connecting rod and a crankshaft to which the connecting rod is coupled by bearing means, the lubricant passage means including a passage extending to said bearing means.

4. In a lubricating system as set forth in claim 3 wherein the lubricant passage means includes a recess formed in a cheek of the crankshaft in which the throw is formed and a lubricant passage extending from the recess to the bearing means.

5. In a lubricating system as set forth in claim 4 wherein there is an oil plate positioned in the crankshaft recess and which has a discharge spout communicating with the passage to the bearing means.

6. In a lubricating system as set forth in any one of claims 1 through 5 further including check valve means in the lubricant passage means for precluding reverse flow from the chamber to the induction passage.

7. In a lubricating system as set forth in claim 6 wherein the charge forming device includes a main fuel nozzle for discharge a fuel lubricant mixture into an air passage and the lubricant passage means includes an inlet pipe extending into the induction passage downstream of the point of discharge of the main fuel nozzle.

8. In a lubricating system as set forth in claim 6 wherein the charge forming device induction passage comprises a main induction passage and the lubricating passage means includes a supplemental induction passage in the charge forming device supplied with fuel lubricant mixture.

* * * * *